US006379172B1

(12) United States Patent
Howell et al.

(10) Patent No.: US 6,379,172 B1
(45) Date of Patent: Apr. 30, 2002

(54) HIGH CURRENT CAPACITY SOCKET WITH SIDE CONTACTS

(75) Inventors: David G. Howell, Gilbert, AZ (US); Pei-Lun Sun, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/016,064

(22) Filed: Dec. 6, 2001

Related U.S. Application Data

(63) Continuation-in-part of application No. 09/917,380, filed on Jul. 27, 2001, now Pat. No. 6,328,574.

(51) Int. Cl.[7] ..... H01R 4/50
(52) U.S. Cl. ..... 439/342; 439/259
(58) Field of Search ..... 439/342, 259, 439/266

(56) References Cited

U.S. PATENT DOCUMENTS 5,217,383 A * 6/1993 Hildebrandt et al. ..... 439/259
5,415,559 A * 5/1995 Ichimura ..... 439/259

* cited by examiner

*Primary Examiner*—Tho D. Ta
(74) *Attorney, Agent, or Firm*—Wei Te Chung

(57) ABSTRACT

A high current capacity socket (1) for connecting with an IC package (5) includes a base (10) with a number of side contacts (40) disposed at a side thereof, a cover (20) movably mounted on the base and defining a number of channels (24) therein, and an actuation mechanism for actuating the side contacts to releasably engage with current/grounding conductors (54) of the IC package. The actuation mechanism includes a lever (31), a number of projections (32) formed on the side contacts, and a number of embossments (34) formed on the cover and extending into the channels.

14 Claims, 5 Drawing Sheets

HIGH CURRENT CAPACITY SOCKET WITH SIDE CONTACTS

This is a continuation-in-part application of a application Ser. No. 09/917,380 filed Jul. 27, 2001, now U.S. Pat. No. 6,328,574.

BACKGROUND OF THE INVENTION

1. Field of the Invention

The present invention relates to a high current capacity socket with side contacts, and particularly to a high current capacity socket having an actuation mechanism for actuating side contacts thereof.

2. Description of Related Art

High current capacity sockets are used to transmit signals and conduct current between a printed circuit board and an IC (Integrated Circuit) package. A conventional high current capacity socket for connecting with an IC package includes a base defining a plurality of passageways therein, a cover movably mounted on the base and defining a plurality of holes in alignment with the passageways, and a plurality of contacts received in the passageways of the base. The IC package has a plurality of downwardly extending pins for engaging with the contacts of the socket. The downwardly extending pins include signal pins, current pins and grounding pins. Accordingly, the contacts received in the passageways of the base of the socket also include signal contacts, current contacts and grounding contacts. This will inevitably enlarge size of the socket. As a result, manufacture of the socket will be complicated and the socket will occupy more space on a printed circuit board.

In order to solve the above-mentioned disadvantages of the related art, the aforementioned parent application discloses a high current capacity socket with side contacts for directly engaging with conductive conductors on opposite sides of an IC package. The side contacts consist of current contacts for conducting current and grounding contacts for grounding purpose between the IC package and a printed circuit board.

When the IC package is assembled on the base of the socket, the side contacts directly engage with the conductive conductors of the IC package. To enable the side contacts to be movably engaged with the conductive conductors, it is desired to design an actuation mechanism to achieve this purpose.

Hence, the present invention aims to provide an improved high current capacity socket having an actuation mechanism to actuate the side contacts to engage/disengage with/from the conductive conductors of the IC package.

SUMMARY OF THE INVENTION

Accordingly, one object of the present invention is to provide a high current capacity socket having an actuation mechanism for actuating side contacts thereof to engage/disengage with/from an integrated circuit package.

Another object of the present invention is to provide a high current capacity socket having a side contact actuation mechanism which is compatible with existing actuation mechanism for a ZIF (Zero Insertion Force) socket.

In order to achieve the objects set forth, a high current capacity socket for connecting with an IC package in accordance with the present invention comprises a base with a plurality of side contacts disposed at a side thereof, a cover movably mounted on the base and defining a plurality of channels therein for the side contacts projecting therethrough, and an actuation mechanism for actuating the side contacts. The actuation mechanism includes a lever, projections formed on the side contacts, and embossments formed on the cover and extending into the channels. The IC package includes a dielectric housing, and a plurality of current/grounding conductors disposed on a side face of the housing. When the socket is in an open position, the projections of the side contacts engage with the embossments of the cover to cause the side contacts to spring outwardly and disconnect from the current/grounding conductors of the IC package. When the socket is in a closed position, the projections of the side contacts disengage from the embossments of the cover to cause the side contacts to spring back and connect with the current/grounding conductors of the IC package.

Other objects, advantages and novel features of the invention will become more apparent from the following detailed description when taken in conjunction with the accompanying drawings.

DETAILED DESCRIPTION OF THE INVENTION

Figure 1:
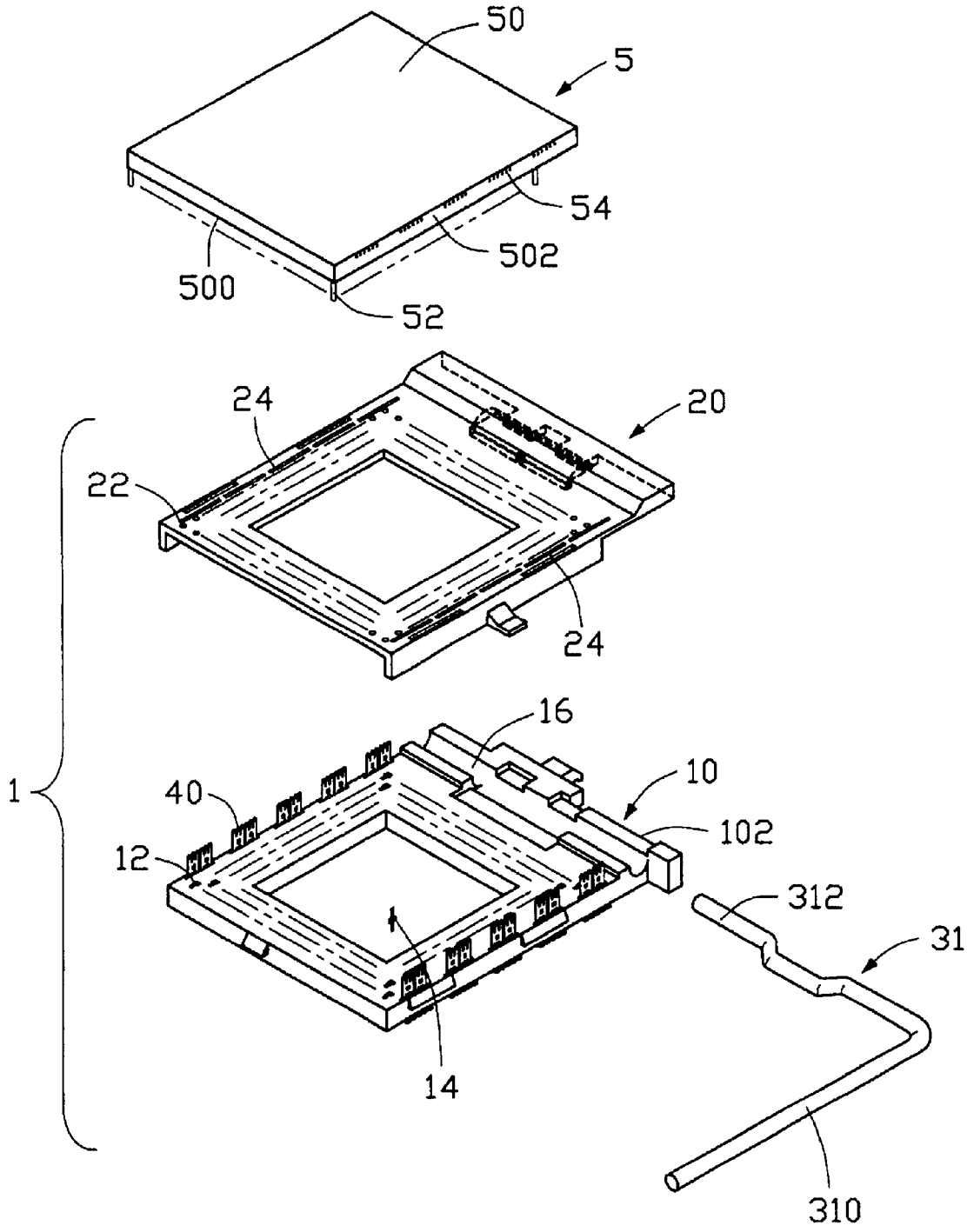
FIG. 1 is an exploded, perspective view of a high current capacity socket in accordance with the present invention and an IC package.
Figure 2:
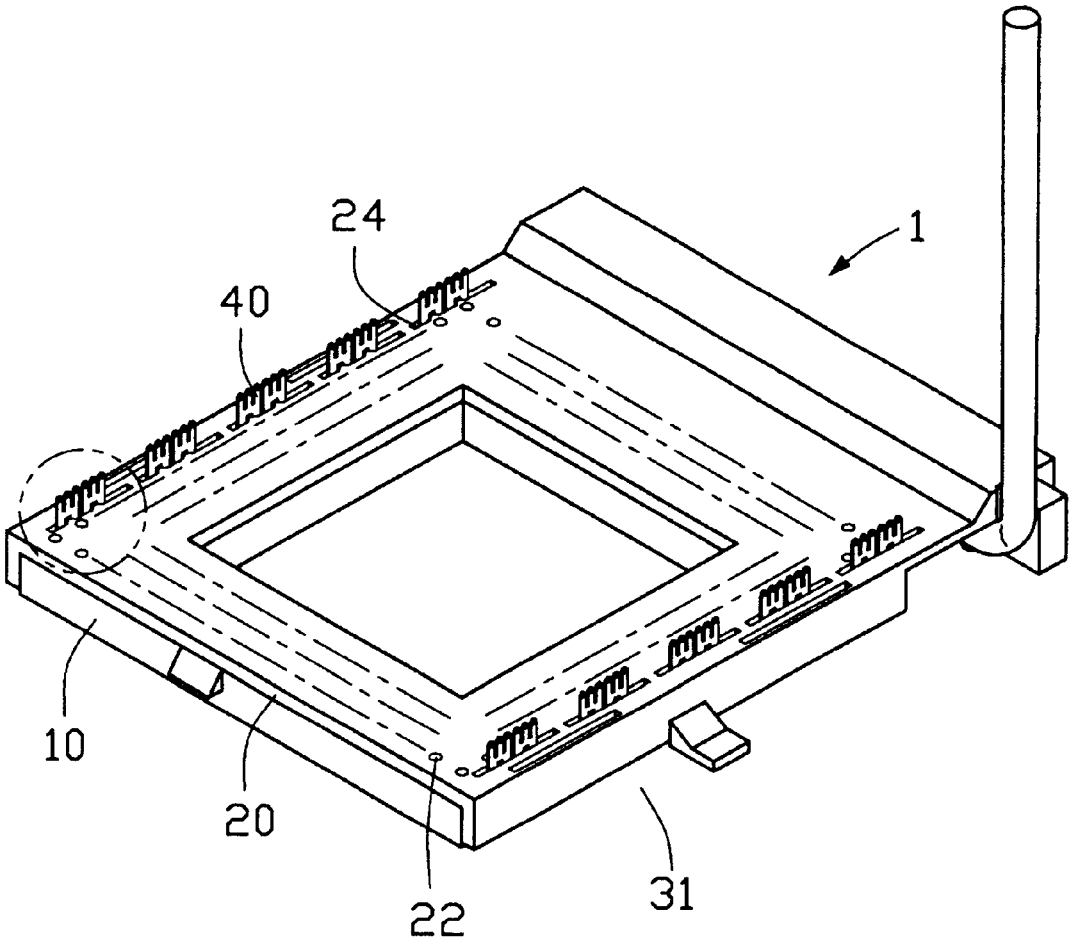
FIG. 2 is an assembled view of the high current capacity socket of FIG. 1.

Referring to FIGS. 1 and 2, a high current capacity socket 1 for connecting an IC (Integrated Circuit) package 5 with a printed circuit board 6 (FIGS. 5 and 7) in accordance with the present invention comprises a rectangular base 10 with side contacts 40 disposed at opposite sides thereof, a rectangular cover 20 movably mounted on the base 10, and an actuation mechanism for actuating the side contacts 40. A detailed description of the actuation mechanism will be provided hereinafter. The IC package 5 includes a rectangular dielectric housing 50, an array of signal conductors 52 projecting beyond a bottom face 500 of the housing 50, and a plurality of conductive conductors 54 disposed on each of two opposite side faces 502 of the housing 50. The conductive conductors 54 include current and grounding conductors.

The base 10 defines an array of passageways 12 with a plurality of signal contacts 14 received therein. As is clearly shown in FIG. 5, each signal contact 14 includes a mating portion 140 for mating with a corresponding signal conductor 52 of the IC package 5, and a solder portion 144 for being soldered to the printed circuit board 6. The base 10 is formed with a recess 16 in a lateral direction and adjacent to a rear face 102 thereof.

Figure 3:
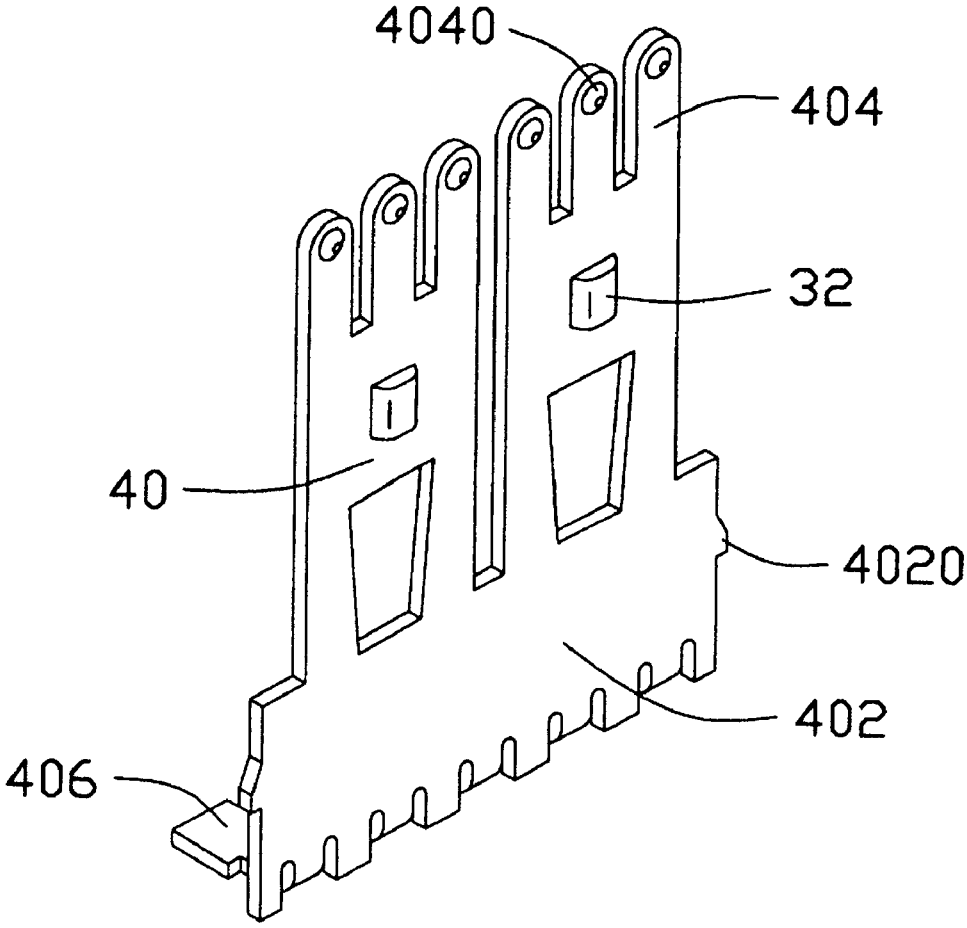
FIG. 3 is an enlarged view of a side contact of the socket.

The side contacts 40 consist of a plurality of current and grounding contacts. Referring to FIG. 3, each side contact 40 includes an intermediate portion 402, six finger-like contacting portions 404 upwardly extending from the intermediate portion 402, and five solder pads 406 perpendicular to the contacting portions 404. Each of the contacting portions 404 defines a knob 4040 at a top end thereof for connecting with a corresponding current/grounding conductor 54 of the IC package 5. The solder pads 406 are soldered to the printed circuit board 6 for transmitting current or for grounding. A pair of barbs 4020 are formed on opposite sides of the intermediate portion 402 for securing the side contact 40 in the base 10.

The cover 20 defines a plurality of holes 22 in alignment with the passageways 12 of the base 10 allowing the signal conductors 52 of the IC package 5 to extend therethrough to mate with the mating portions 140 of the signal contacts 14. The cover 20 defines a plurality of channels 24 adjacent to opposite sides thereof for the contacting portions 404 of the side contacts 40 to project therethrough.

In a preferred embodiment of the present invention, the actuation mechanism includes a lever 31, a plurality of projections 32 formed on the side contacts 40, and a plurality of embossments 34 (FIG. 4) integrally formed on the cover 20 and extending into the corresponding channels 24. The lever 31 sandwiched between the base 10 and the cover 20 includes an operating handle 310 exposed to and accessible from outside and a cam shaft 312 received in the recess 16, whereby when the operating handle 310 is rotated from a vertical position to a horizontal position, the cover 20 can be moved relative to the base 10 in a rear-to-front direction.

Figure 4:
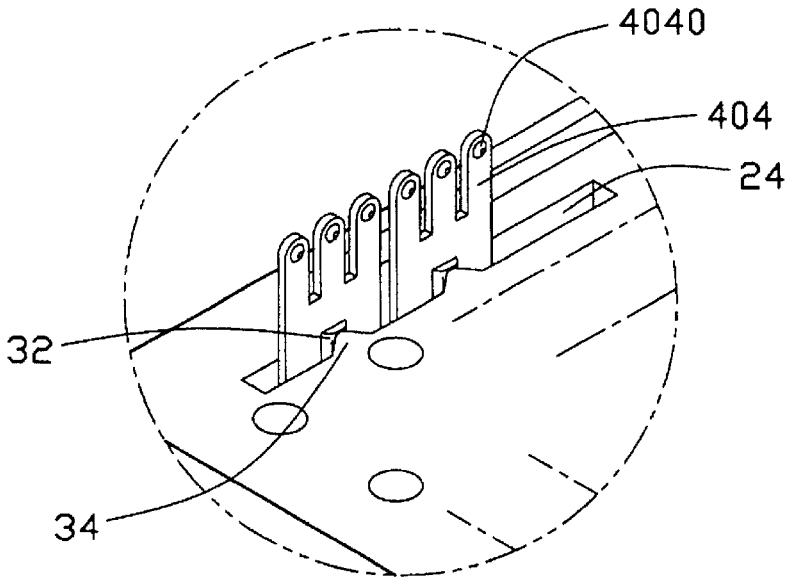
FIG. 4 is an enlarged view of a circled portion in FIG. 2, showing a projection of the side contact engaged with an embossment of a cover of the socket.
Figure 5:
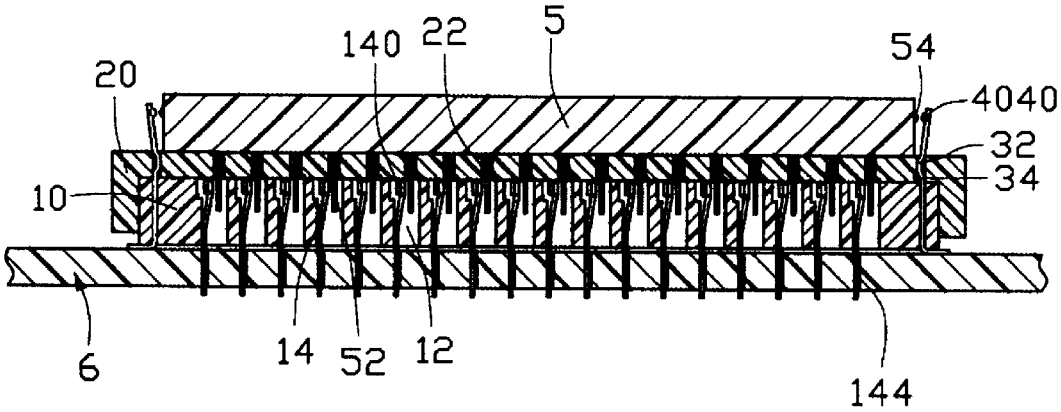
FIG. 5 is a cross-sectional view showing the side contacts disengaged from conductive conductors of the IC package.

Referring to FIGS. 4 and 5, when the socket 1 is in an open position, i.e., the operating handle 310 of the lever 31 is in a vertical direction, the projections 32 on the side contacts 40 engage with the embossments 34 on the cover 20 to actuate the contacting portions 404 of the side contacts 40 to deflect outwardly, whereby the knobs 4040 of the side contacts 40 disconnect from the current/grounding conductors 54 of the IC package 5. At the same time, the signal contacts 14 of the socket 1 disengage from the signal conductors 52 of the IC package 5.

Figure 6:
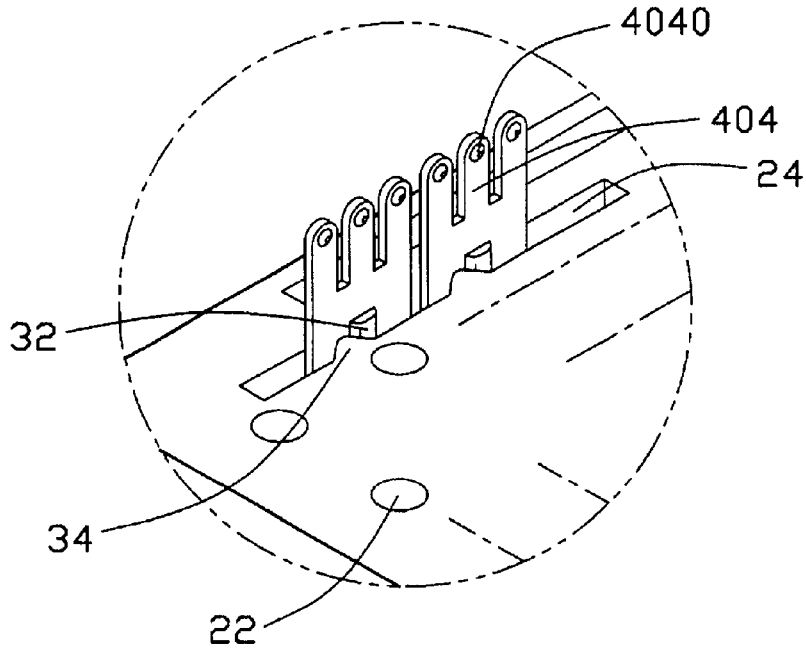
FIG. 6 is a view similar to FIG. 4 but showing the projection of the side contact disengaged from the embossment of the cover.
Figure 7:
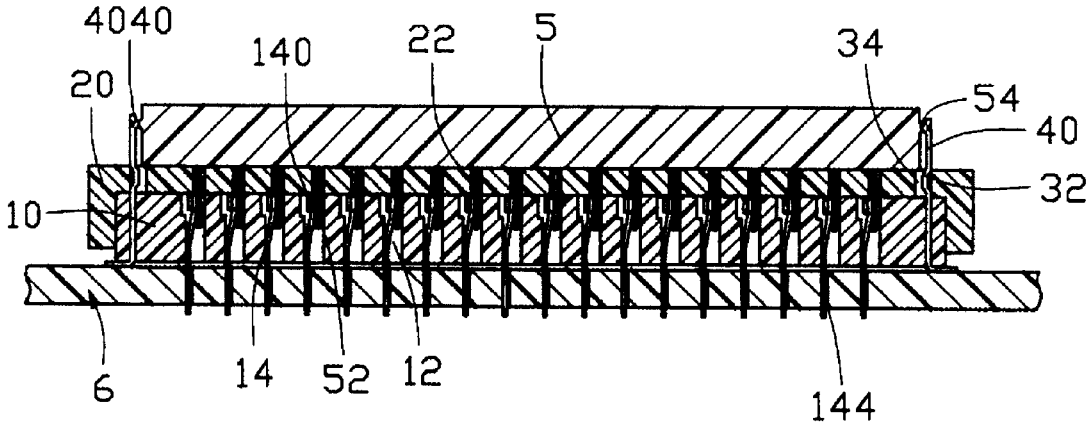
FIG. 7 is a cross-sectional view showing the side contacts engaged with the conductive conductors of the IC package.

Referring to FIGS. 6 and 7, when the socket 1 is in a closed position, i.e., the operating handle 310 of the lever 31 is rotated from a vertical direction to a horizontal direction, the projections 32 on the side contacts 40 disengage from the embossments 34 on the cover 20 to enable the contacting portions 404 of the side contacts 40 to return back, whereby the knobs 4040 of the side contacts 40 connect with the current/grounding conductors 54 of the IC package 5. At the same time, the signal contacts 14 of the socket 1 electrically connect with the signal conductors 52 of the IC package 5. Therefore, signal and current transmission is established between the IC package 5 and the printed circuit board 6. On the other hand, a grounding path between the IC package 5 and the printed circuit board 6 is also established.

As indicated in FIGS. 5 and 7, a distance between the contacting portions 404 of opposite side contacts 40 changes with movement of the cover 20. When the cover 20 is in an original position, i.e., the operating handle 310 of the lever 31 is in a vertical direction, the signal contacts 14 disengage from the signal conductors 52 of the IC package 5, and the projections 32 of the side contacts 40 engage with the embossments 34 of the cover 20, the contacting portions 404 of the side contacts 40 deflect outwardly and the distance between the opposite contacting portions 404 is largest. When the cover 20 is in a final position, i.e., the operating handle 310 of the lever 31 is in a horizontal direction, the signal contacts 14 engage with the signal conductors 52 of the IC package 5, and the projections 32 of the side contacts 40 disengage from the embossments 34 of the cover 20, the contacting portions 404 of the side contacts 40 return back and the distance between the opposite contacting portions 404 is smallest.

Although in this embodiment, the actuation mechanism includes a lever 31 for actuating the cover 20 to move along the base 10, it should be noted that the lever 31 also can be displaced by a cam mechanism or other equivalent designs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high current capacity socket comprising:

a base;

a cover mounted on the base and being movable along the base in a first direction;

a plurality of side contacts disposed at a side of the base, each side contact having a contacting portion projecting beyond the cover;

an actuation mechanism for actuating the contacting portions of the side contacts to move in a second direction perpendicular to the first direction, wherein the cover defines a plurality of channels for the contacting portions of the side contacts to protect therethrough; and wherein the actuation mechanism includes a plurality of embossments integrally formed on the cover and extending into corresponding channels, a plurality of projections formed on the side contacts corresponding to the embossments, and a lever for actuating the cover to move along the base.

2. The high current capacity socket as claimed in claim 1, wherein the lever includes a rotatable operating for actuating the cover to move from an original position to a final position.

3. The high current capacity socket as claimed in claim 2, wherein the projections of the side contacts engage with the embossments of the cover when the cover is in the original position, and wherein the projections of the side contacts disengage from the embossments of the cover when the cover is in the final position.

4. A high current capacity socket comprising:

a base;

a cover movably mounted on the base;

a plurality of side contacts disposed at opposite sides of the base, each side contact having a contacting portion projecting beyond the cover;

an actuation mechanism for actuating the cover to move along the base;

wherein a distance between the contacting portions of opposite side contacts changes with movement of the cover;

wherein the cover defines a plurality of channels for the contacting portions of the side contacts to project therethrough; and wherein the actuation mechanism includes a plurality of embossments integrally formed on the cover and extending into corresponding channels, a plurality of projections formed on the side contacts corresponding to the embossments, and a lever for actuating the cover to move along the base.

5. The high current capacity socket as claimed in claim 4, wherein the lever includes a rotatable operating handle for actuating the cover to move from an original position to a final position.

6. The high current capacity socket as claimed in claim 5, wherein the distance between the opposite contacting portions is largest when the cover is in the original position, and wherein the distance between the opposite contacting portions is smallest when the cover is in the final position.

7. A socket assembly comprising:

a base;

a cover movably mounted on the base;

an array of signal contacts disposed in the base;

a plurality of current/grounding contacts disposed around the array of the signal contacts;

an integrated circuit package positioned on the cover, the package including an insulative housing, an array of signal conductors extending from a bottom face of the housing, and a plurality of current/grounding conductors disposed on a side face of the housing;

an actuation mechanism for actuating the cover to move along the base and for actuating the current/grounding contacts to engage/disengage with/from the current/grounding conductors of the package;

wherein when the cover is in an original position where the signal contacts disengage from the signal conductors of the package, the current/grounding contacts of the socket disengage from the current/grounding conductors of the package, and when the cover is actuated by the actuation mechanism to arrive at a final position where the signal contacts engage with the signal conductors of the package, the current/grounding contacts of the socket engage with the current grounding conductors of the package; and wherein the cover defines a plurality of channels for the current/grounding contacts to project therethrough.

8. The socket assembly as claimed in claim 7, wherein the actuation mechanism includes a plurality of embossments integrally formed on the cover and extending into corresponding channels, a plurality of projections formed on the current/grounding contacts corresponding to the embossments, and a lever for actuating the cover to move along the base.

9. The socket assembly as claimed in claim 8, wherein when the cover is in the original position, the projections of the current/grounding contacts engage with the embossments of the cover, and wherein when the cover is in the final position, the projections of the current/grounding contacts disengage from the embossments of the cover.

10. A socket comprising:

a stationary base;

a cover mounted upon the base, said cover being slidable relative to the base along a front-to-back direction by an actuator;

a plurality of signal contacts disposed in an interior region of said base;

a plurality of side contacts disposed in at least a portion of a periphery of the base and upwardly extending above both the base and the covers;

wherein said signal contacts do not extend above the base; and wherein said cover defines a plurality of channels receiving said side contacts, respectively.

11. The socket as claimed in claim 10, wherein said side contact is larger than said signal contact.

12. The socket as claimed 10, wherein said side contacts are arranged along a lateral side of said base parallel to said front-to-back direction.

13. An electrical assembly comprising:

an insulative base;

an insulative cover mounted upon the base and being slidable relative to the base along a longitudinal direction, a plurality of signal contacts disposed in an interior region of the base;

a plurality of side contacts disposed in at least a portion of a periphery of the base;

an IC package mounted atop the cover, said package including signal conductors extending downwardly from a bottom face thereof, and side conductors extending downwardly from at least a side face thereof; wherein the signal conductors are mechanically and electrically inserted through the cover and connected to the signal contacts, and the side conductors are mechanically and electrically connected to the side contacts, after the cover is moved from an open position to a closed position along said longitudinal direction;

wherein said side contacts extend upwardly above both the base and the cover.

14. The assembly as claimed in claim 13, wherein said side contacts are for power transportation.

* * * * *